United States Patent [19]

Veraldi

[11] 4,280,098

[45] Jul. 21, 1981

[54] COAXIAL SPARK GAP SWITCH

[75] Inventor: S. James Veraldi, Burbank, Calif.

[73] Assignee: Veradyne Corp., Burbank, Calif.

[21] Appl. No.: 42,722

[22] Filed: May 25, 1979

[51] Int. Cl.[3] ..... H01T 3/00; H01T 1/08

[52] U.S. Cl. ..... 328/59; 328/249; 313/217; 313/197; 313/231; 313/214; 315/111; 200/149 A; 200/150 R

[58] Field of Search ..... 200/149 A, 150 R; 313/231, 231.2, 231.4, 217, 197, 214; 315/111.2, 111, 340; 328/59, 249

[56] References Cited

U.S. PATENT DOCUMENTS

| | | | |
|---|---|---|---|
| 3,042,828 | 7/1962 | Josephson | 313/214 |
| 3,786,213 | 1/1974 | Holmstrom | 200/149 A |
| 3,983,438 | 9/1976 | Levatter et al. | 313/217 |
| 4,011,426 | 3/1977 | Lange | 200/149 A |
| 4,034,175 | 7/1977 | Gratzmuller | 200/150 R |
| 4,198,590 | 4/1980 | Harris | 313/197 |

*Primary Examiner*—John S. Heyman

*Attorney, Agent, or Firm*—Smyth, Pavitt, Siegemund & Martella

[57] ABSTRACT

The switch is usable for switching currents of 40 kiloamperes at 250 kilovolts to produce current pulses a few nanoseconds in duration at kilohertz rates. In a preferred embodiment, the switch includes three independently-triggerable spark gaps which are fired in a desired predetermined sequence; for example, cyclically. The three spark gaps are cooled by parallel streams of fluid, which is supplied to the switch under pressure. Because the firing rate of each individual spark gap is limited by the time required for the fluid to sweep the ions produced by firing out of the spark gap, a threefold increase in firing rate is achieved by the preferred embodiment. In another aspect of the invention, a high-performance low-induction coaxial spark gap switch employs a hollow trigger electrode which has a hole in its wall so that the fluid can flow along both its inner and outer surfaces to cool and clean them.

9 Claims, 7 Drawing Figures

COAXIAL SPARK GAP SWITCH

BACKGROUND OF THE INVENTION

1. Field of the Invention

The present invention is in the field of spark gap switches, and particularly relates to a coaxial spark gap switch capable of switching 40 kiloamperes at 250 kilovolts at repetition rates on the order of 1,000 Hz and producing current pulses only a few nanoseconds wide, the pulses having a rise time on the order of one nanosecond.

2. The Prior Art

In U.S. Pat. No. 3,042,828 issued July 3, 1962, Josephson discloses a spark gap switch having a trigger electrode and usable at high voltages and currents. Josephson's switch is not coaxial, and there is no provision for flowing a fluid through the switch for cooling and cleaning purposes.

In the U.S. Pat. No. 3,983,438, issued Sept. 28, 1976 to Levatter et al., there is shown a spark gap switch having two electrodes in a coaxial configuration, and employing a dielectric liquid or a saturated vapor flowing through the switch. The switch disclosed in this patent does not include a trigger electrode.

The present invention grew out of attempts to solve a problem which was not addressed by the known prior art and which had long frustrated workers in the range of parameters recited above. That problem was how to obtain pulse repetition rates in the kilohertz range.

After each firing of a spark gap, a cloud of ions remains in the space between the electrodes and on the electrodes. These ions are usually swept out of the gap by a stream of dielectric fluid directed through the gap. The spark gap cannot be re-fired until the ions have been swept out, since their presence will lead to premature or even spontaneous firing. Normally it is the time required for sweeping out the ions which limits the firing rate (pulse repetition frequency) of a switch.

Although it might seem plausible to attempt to increase the firing rate by increasing the flow velocity of the sweeping fluid, this approach is fraught with serious problems which rendered it impractical at the time of the present invention.

Typically, the sweeping fluid was pressurized and the pressure drove the fluid through a constricted structure near the gap. Higher flow speeds were obtainable only be increasing the pressure, and required a stronger and heavier structure to confine the pressurized fluid.

It was also found that electrode erosion was accelerated at higher flow speeds, thereby shortening the useful life of the spark gap.

Further, it was found that to obtain the higher pressures needed to produce the increased flow speeds required prodigious amounts of pumping power. In a typical system, the pumping power was proportional to the third power (cube) of the flow speed. To obtain a three-fold increase in firing rate required a three-fold increase in flow speed of the sweeping fluid, and this, in turn, required a twenty-seven-fold increase in pumping power.

At the time of the present invention, further increases in the firing rate could not be obtained in a practical device because of these limiting factors. A fundamentally different approach was needed, and the present invention arose in response to this need.

SUMMARY OF THE INVENTION

In accordance with one aspect of the present invention, the firing rate limitation is overcome by providing more than one spark gap, which are triggerable in a predetermined sequence so that some of the spark gaps previously fired are being swept clean while others of the spark gaps are being fired. Thus, the present invention permits the firing rate of the switch to be enhanced by a factor equal to the number of individual spark gaps provided in the switch. In this manner, the present invention provides the basic structural improvements necessary for achieving a faster firing rate with limited flow velocity.

In a preferred embodiment there is disclosed a switch including three coaxial spark gaps which are independently triggerable. In this embodiment, a cyclindrical housing is sealed at each end by insulative end plates so that a cylindrical space is enclosed within the housing. The cylindrical space within the housing is divided into two chambers by a first common electrode which extends radially across the enclosed space parallel to the end plates. This first common electrode includes three axially extending passages through which the first chamber communicates with the second chamber.

The housing includes an inlet port leading to the first chamber and an outlet port leading from the second chamber so that fluid supplied under pressure to the first chamber through the inlet port passes through the passages of the first common electrode into the second chamber, from which the fluid is discharged through the outlet port. The fluid is used for cooling and cleaning the switch, and the word "fluid" is used in its most general sense to include both liquids and gases. It is known in the art to employ various types of fluids such as dielectric liquids, saturated gases and vapors, as well as compressed air and nitrogen.

Three electrically isolated trigger electrodes are attached to the insulative plate of the first chamber. Each of these three trigger electrodes includes its own hollow cylindrical portion which extends into one of the three passages in the first common electrode. Each of the hollow cylindrical portions of the trigger electrodes includes an opening to permit the fluid in the first chamber to flow into the space inside the hollow cylindrical portion.

Attached to the insulative end plate of the second chamber are three electrically-connected second electrodes which extend within the second chamber and into the hollow cylindrical portions of the trigger electrodes. Fluid passing from the first chamber to the second chamber flows between the outside surface of the trigger electrode and the wall of the passage of the common first electrode, and also flows on a parallel path through the space between each of second electrodes and the inside of the trigger electrode associated therewith. This flow of fluid cools the switch and washes out ionization, thereby preventing shorting of the switch. The first chamber supplies fluid in parallel to each of the three spark gaps of the preferred embodiment in a continuous flow.

Although three individually triggerable spark gaps are employed in the exemplary preferred embodiment, it is clear that any reasonable number of spark gaps could be employed in accord with the invention.

In another aspect of the invention, there is disclosed a coaxial spark gap switch having a single coaxial trigger electrode. The switch is configured to have extremely low inductance, on the order of 15 nanohenrys. A fluid is caused to flow through the switch to provide cooling and cleaning, and the structure of the switch permits the hollow trigger electrode to be cooled on both its inside and its outside surfaces.

In this embodiment, the switch includes a cylindriform conductive housing closed at both ends by plates of insulative material to enclose a hollow cylindrical space within the housing. This hollow cylindrical space is divided into two chambers by a first electrode which has the form of a partition extending across the hollow cylindrical space parallel to the end plates. This first electrode is in electrical contract with the housing of the switch. The housing also includes an entry port for fluid leading to the first chamber, and an exit port for fluid leading from the second chamber. The first electrode has a passage extending axially through it, through which the first and second chambers communicate.

A trigger electrode is attached to the insulative end plate of the first chamber. This trigger electrode includes a hollow cylindrical portion which extends from within the first chamber into the passage through the first electrode. The hollow cylindrical portion of the trigger electrode includes at least one aperture to permit the fluid in the first chamber to flow inside of the hollow cylindrical portion. The fluid of the first chamber also flows along the outside surface of the hollow cylindrical portion of the trigger electrode as the fluid flows form the first chamber to the second chamber.

This embodiment also includes a second electrode extending axially from the insulative end plate of the second chamber into the hollow cylindrical portion of the trigger electrode. This second electrode also is cooled and cleaned by the flow of the fluid within the hollow cylindrical portion of the trigger electrode. Thus, the switch of the present invention includes three electrodes which are coaxial and which are spaced from one another so that cooling and cleaning fluid can flow over their active surfaces.

The novel features which are believed to characterize the invention, both as to its organization and method of operation, together with further objects and advantages thereof, will be better understood from the following description considered in connection with the accompanying drawings in which several embodiments of the invention are illustrated by way of example. It is to be expressly understood, however, that the drawings are for the purpose of illustration only and are not intended as a definition of the limits of the invention.

DETAILED DESCRIPTION OF THE PREFERRED EMBODIMENT

Figure 1:
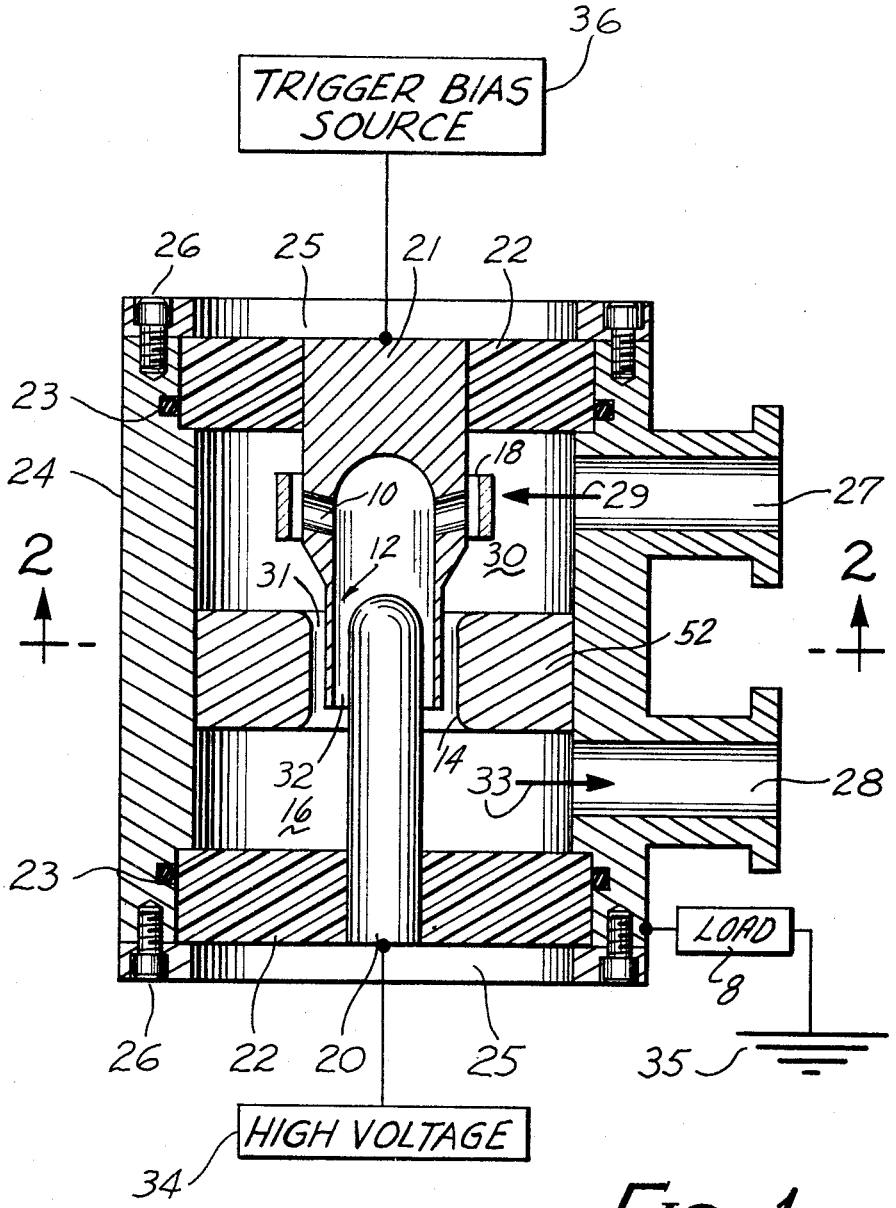
FIG. 1 is a cross-sectional elevation view of a first embodiment of the present invention showing a switch having a single spark gap.
Figure 2:
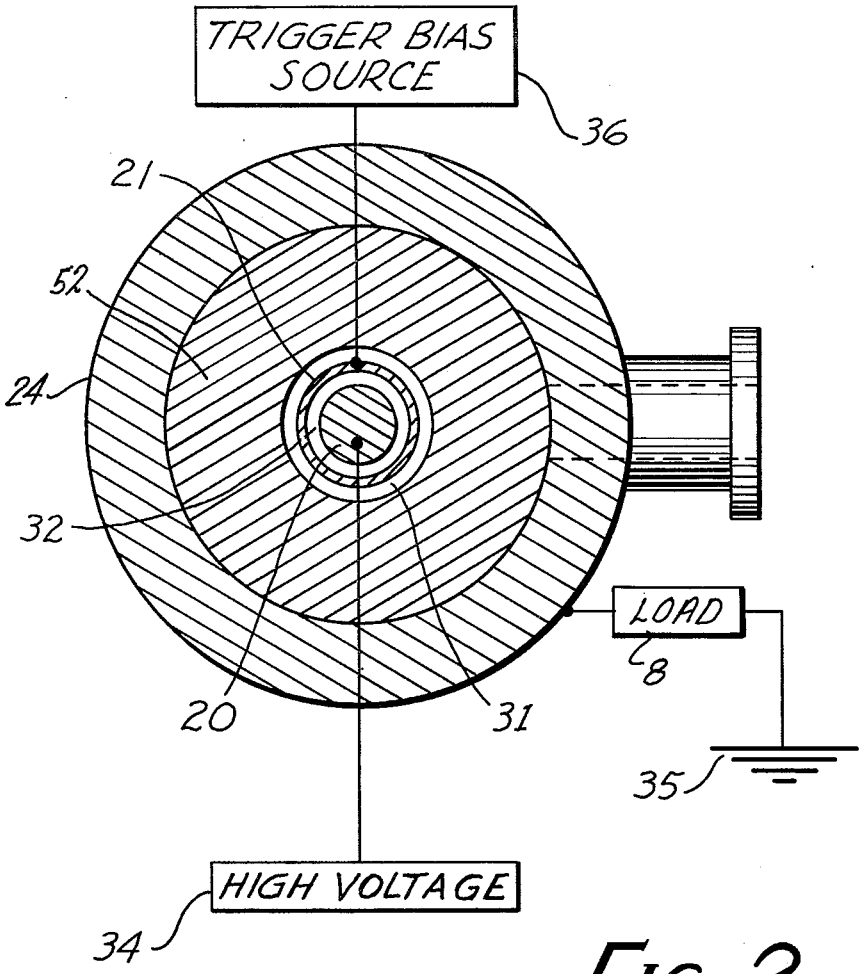
FIG. 2 is a cross-sectional view of the switch shown in Figure of taken in the direction 2—2 of FIG. 1.

Turning now to the drawings, it will be seen that FIGS. 1 and 2 relate to a first embodiment of the invention, which embodiment is a coaxial switch having only a single spark gap. FIGS. 3-7 relate to a second, preferred, embodiment in which a switch is provided with more than one spark gap and in which the more than one spark gap are individually triggerable.

As shown in FIG. 1, the switch having a single spark gap includes a generally cylindrical housing 24 which is closed at each end by insulative end plates 22. In one embodiment of the invention, the insulative end plates 22 are made of a polycarbonate resin, although any insulative material of adequate mechanical strength could be used. The housing 24 in association with the end plates 22 define a cylindrical space within the housing. The O-rings 23 provide seals between the housing 24 and the end plates 22 to prevent leakage of pressurized fluid from the cylindrical space. The end plates 22 are secured to the housing 24 by the end clamp rings 25 which are held in place by the threaded fasteners 26.

As shown in FIG. 1, a first electrode 52 partitions the cylindrical space into a first chamber 30 and a second chamber 16. In an alternative embodiment, the first electrode 52 is an integral part of the housing 24. As shown in FIG. 1, the first electrode 52 includes portions 14 defining a passage or aperture which extends through the first electrode 52 in the axial direction and through which the first chamber 30 communicates with the second chamber 16. The housing 24 includes an entry port 27 which opens into the first chamber 30 and the housing further includes an exist port 28 which opens into the second chamber 16. Fluid supplied to the entry port 27 under pressure flows into the first chamber 30, and as will be seen below, passes through the passage in the first electrode 52 into the second chamber 16, from which the fluid is discharged through the exist port 28. The flow of fluid is denoted by the arrows 29, 33 of FIG. 1. In a preferred embodiment, one or more baffles 18 are also included within the first chamber 30 to promote turbulance of the flowing fluid.

A trigger electrode 21 is attached to the insulative end plate of the first chamber 30. The trigger electrode includes a hollow cylindrical portion 12 which extends from a position within the first chamber 30 into and concentric with the passage in the first electrode 52. In accordance with the present invention, the hollow cylindrical portion 12 is provided with a hole or opening 10 through which the fluid in the first compartment 30 can enter the space within the hollow cylindrical portion 12.

A second electrode 20 is attached to the end plate of the second chamber 16 and extends within the second chamber 16 and into the space within the hollow cylindrical portion 12 of the trigger electrode 21.

As can be seen from FIG. 1, the first electrode 52, the trigger electrode 21 and the second electrode 20 are concentric and are separated by the spaces 31, 32 through which the fluid flows from the first chamber 30 into the second chamber 16. The coaxial arrangement of the electrodes shown in FIG. 1 results in extremely low inductance, on the order of 15 nanoHenrys. The flowing fluid flushes the spaces 31, 32 simultaneously, that is, in parallel, thereby permitting the products of ionization to be swept away more rapidly than would be possible if the electrodes were arranged in a series of linear arrangement. The aperture 10, which admits fluid to the space within the hollow cylindrical portion of the trigger electrode permits the flowing fluid to cool both the inside and outside surfaces of the hollow cylindrical portion simultaneously.

As is well known in the art, switches of the type shown in FIG. 1 are often used for applying one or more pulses of very high current at a high voltage from a source 34 of high voltage to a load 8. Switches of this type are normally nonconductive because the fluid has sufficient dielectric strength to prevent conduction from occurring. Conduction is initiated by applying a trigger voltage from a trigger bias source 36 to the trigger electrode 21, which is effective to increase the interelectrode electric field sufficiently that the fluid breaks down and becomes conductive. This initiates the desired discharge, and conduction is maintained by the resulting ions as long as the trigger voltage remains applied. Normally, the housing 24 is connected to a ground 35 for safety.

FIG. 2 is a cross sectional view taken along the direction 2—2 as indicated in FIG. 1.

The first embodiment shown in FIGS. 1 and 2 is intended for operation at voltages in the range 100–300 kilovolts and will handle currents as large as 40 kiloamperes. The low inductance of the coaxial electrode arrangement permits a very rapid rise time to be obtained in the current pulses, and rise times on the order of one nanosecond are obtained. Thus, the switch is capable of forming current pulses as narrow as several nanoseconds in pulsewidth. By simultaneously flushing both the spaces 31, 32, pulse repetition rates as fast as 1,000 Hz are obtained. The pulse repetition rate is limited by the time required to sweep the ionized particles out of the spaces 31, 32, and this in turn is limited by the velocity of the fluid. Fluid velocity is limited both by the excessive amounts of power required to produce higher velocity flows as well as by the increasing erosion of the electrodes that accompany higher flow rates. Thus, there appears to be no practical way of increasing the pulse repetition rate of the first embodiment shown in FIGS. 1 and 2.

As mentioned above, higher pulse repetition rates are necessary for certain purposes and the means for producing higher pulse repetition rates at the range of parameters under consideration has long eluded workers in this field. It is this problem of increasing the pulse repetition rate to which the embodiment shown in FIGS. 3–7 is addressed.

Figure 3:
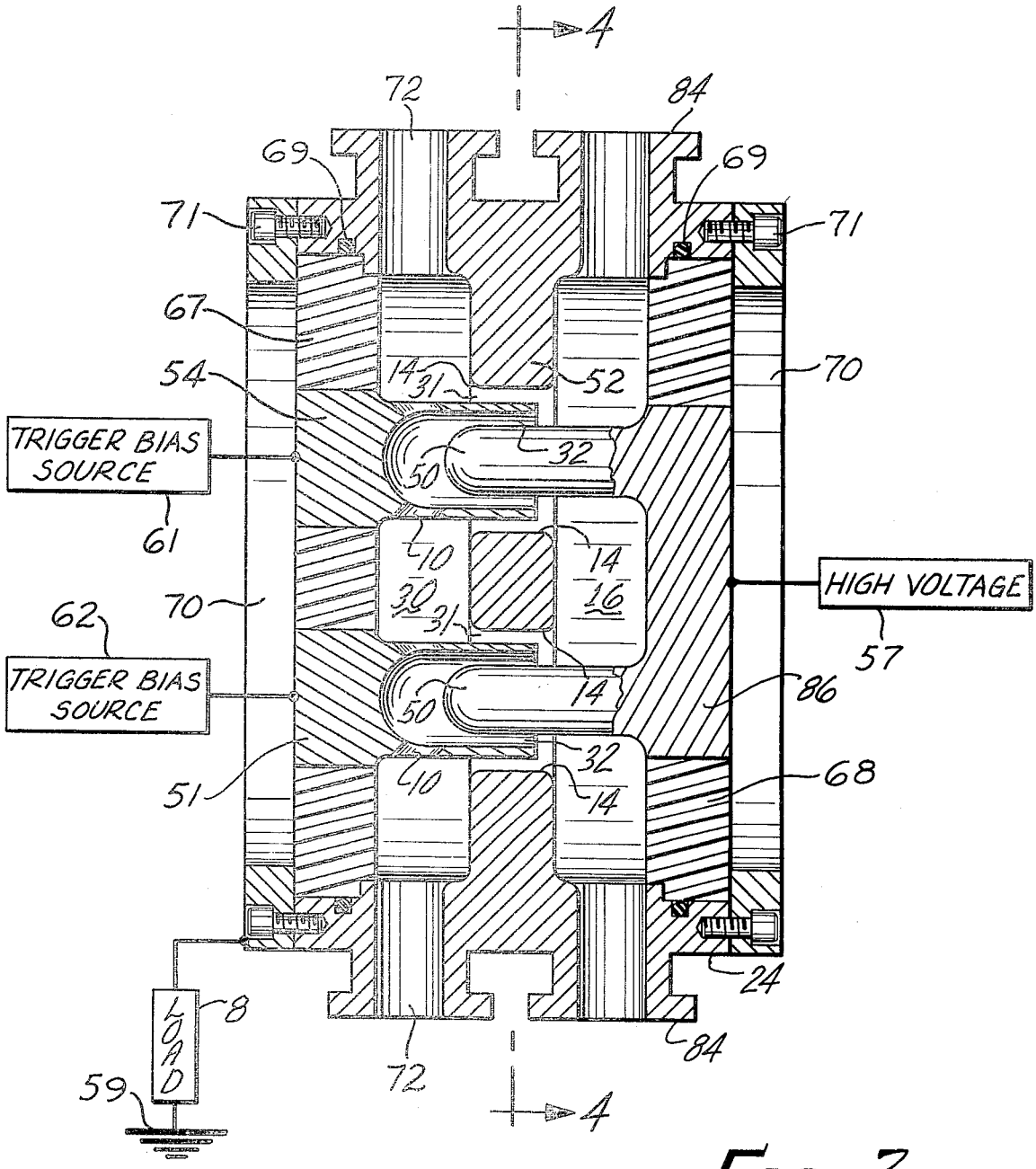
FIG. 3 is a side elevation view in cross section of a second, preferred, embodiment of the present invention, showing a switch having three spark gaps.
Figure 4:
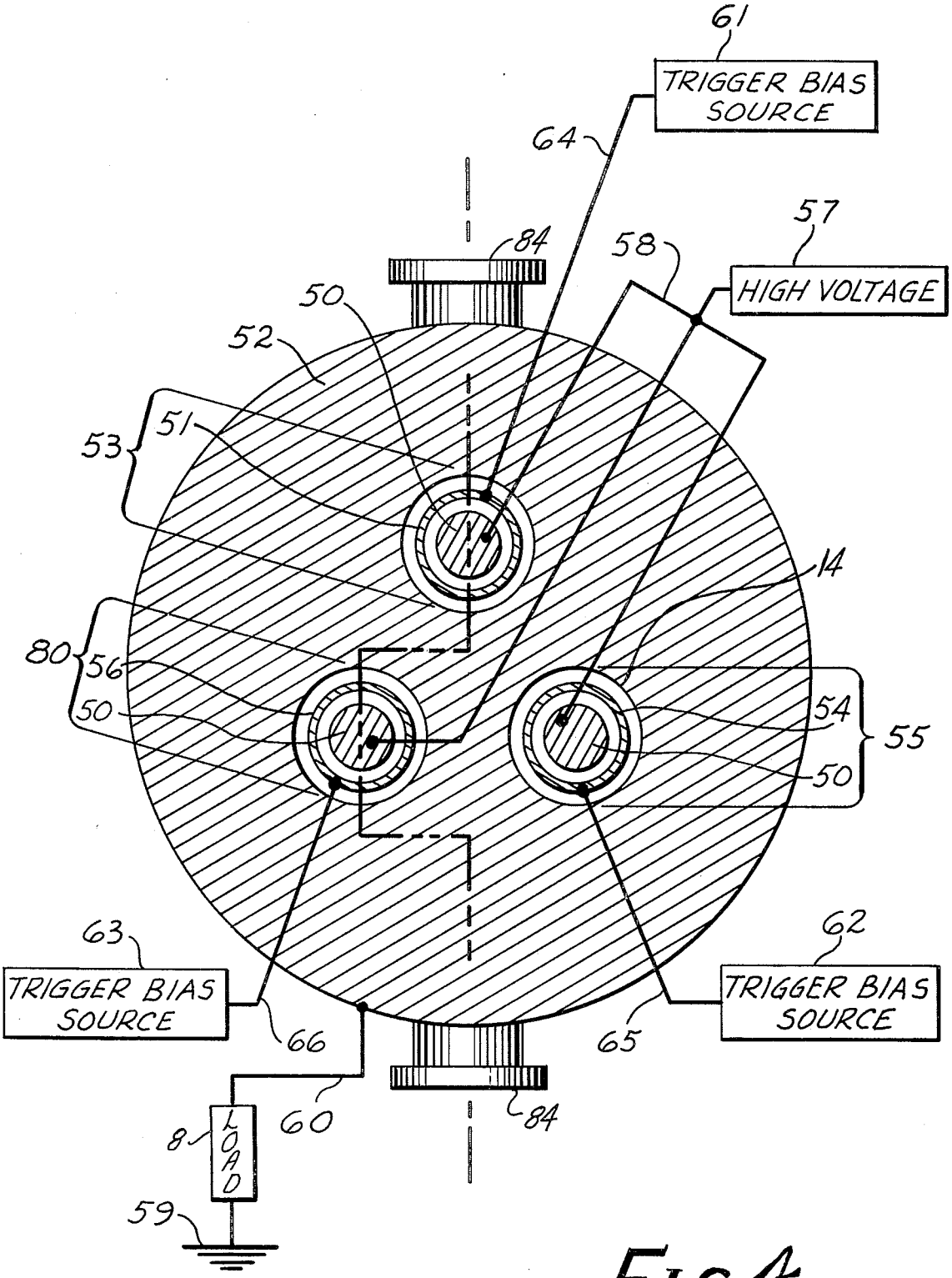
FIG. 4 is a cross-sectional view of the second, preferred, embodiment of FIG. 3, taken in the direction 4—4 indicated in FIG. 3.

As best seen in FIGS. 3 and 4 together, the second, preferred, embodiment includes a cylindrical shaped housing 24 closed at each end by the insulative end plates 67, 68 so that a cylindrical space is defined within the housing 24. A first electrode 52 partitions the cylindrical space into a first chamber 30 and a second chamber 16. The housing 24 includes inlet ports 72 which communicate with the first chamber 30, and outlet ports 84 which communicate with the second chamber 16. The first electrode 52 includes portions defining more than one passage through the first electrode, through which passages the first chamber 30 communicates with the second chamber 16. In the particular exemplary example illustrated in FIGS. 3–7, the switch includes three independently-triggerable spark gaps.

Three trigger electrodes 51, 54, 56 are associated with the three passages in the first electrode 52 and are attached to the insulative end plate 67 in a spaced arrangement so that the trigger electrodes 51, 54, 56 are electrically isolated from each other. Each of the three trigger electrodes of FIG. 3 has a structure similar to that of the trigger electrode 21 of FIG. 1. That is, each of the three trigger electrodes 51, 54, 56 includes a a hollow cylindrical portion which extends from within the first chamber 30 into one of the passages in the first electrode 52. A space is defined within the hollow cylindrical portion of each of the trigger electrodes, and each of these communicates with the first chamber 30 through an aperture or opening 10 in the wall of the hollow cylindrical portion. This permits the fluid in the first chamber 30 to flow through the space inside the hollow cylindrical portion and into the second chamber 16.

Three second electrodes 50 are attached to the insulative end plate 68 and extend from within the second chamber 16 concentrically into the space within the hollow cylindrical portion of each of the triggered electrodes. In one embodiment, the three electrodes 50 are an integral part of a common conductive element 86, while in other embodiments, the electrodes 50 are separate parts electrically interconnected.

When fluid is supplied to the inlet ports 72 under pressure, the fluid flows into the first chamber 30. Some of the fluid flows into the second chamber 16 through the spaces 31, while some of the fluid flows through the holes 10 into the space inside the hollow cylindrical portion of the trigger electrodes 51, 54 56, then through the spaces 32 into the second chamber 16, from which the fluid is discharged through the outlet ports 84. It should be noted that in the embodiment of FIGS. 3–7, as in the embodiment of FIGS. 1 and 2, for a given pressure drop between the first chamber 30 and the second chamber 16, each of the spark gaps will be swept by fluid having the same velocity. That is, for a given pressure drop, the sweep velocity of the fluid is independent of the number of spark gaps employed. Clearly, in the embodiment of FIGS. 3–7, a larger volume of fluid is used, however, this is advantageous since the pumping power required is proportional to the volume of fluid supplied, but generally increases more rapidly than linearly with the velocity required. For example, for compressed air, the pumping power required increases as the cube of the required velocity, approximately. Thus, the embodiment of FIGS. 3–7 uses three times as much pumping power as the embodiment of FIGS. 1–2, but produces three times as great a pulse repetition rate. On the other hand, if the velocity of the fluid flow in the embodiment of FIGS. 1 and 2 were increased sufficiently to permit a three-fold increase in the pulse repetition rate, the pumping power required in the embodiment of FIGS. 1 and 2 would be 27 times greater. Thus, the embodiment of FIGS. 3–7 requires only one-nineth as much power as the embodiment of FIGS. 1 and 2 to produce the higher pulse repetition rate. Further, the higher velocities required in the embodiment of FIGS. 1 and 2 would increase electrode erosion to the point of impracticality.

Figure 5:
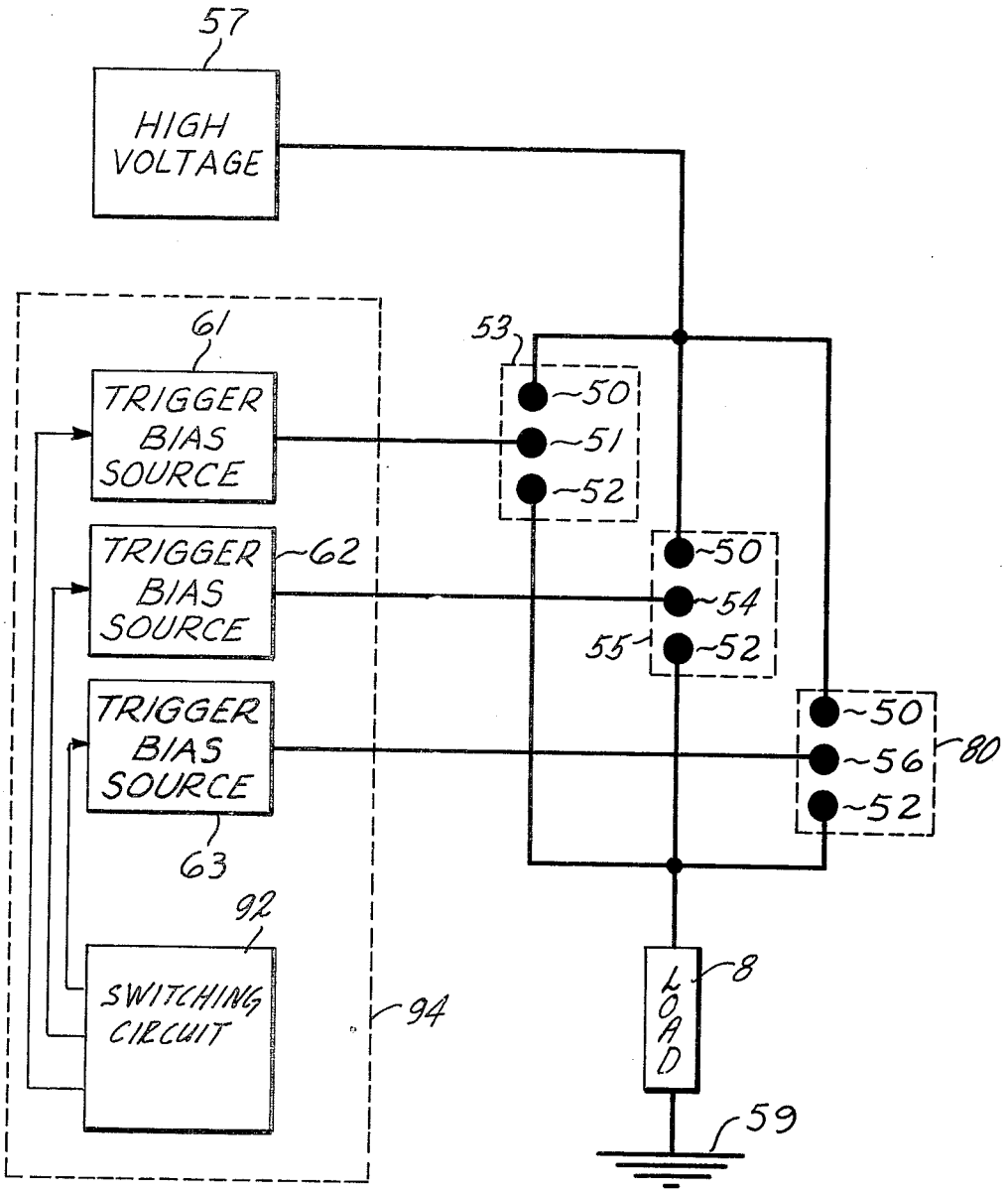
FIG. 5 is an electrical circuit diagram showing the electrical interconnections used in the embodiment of FIGS. 3 and 4.

As indicated in FIG. 4, each of the trigger electrodes 51, 54, 56 is supplied with pulses from its own trigger bias source, in a preferred embodiment. As shown in FIG. 5, the operation of the individual triggered biased sources 61, 62 63 is coordinated by the switching circuit 92 which applies enabling pulses in a desired preset sequence to the trigger bias sources 61, 62, 63. In an alternative embodiment, a single trigger bias source 94 may be used to supply each of the trigger electrodes in turn.

It is understood that the triggering circuitry supplies appropriate pulses to the trigger electrodes 51, 54, 56 to control the duration of the flow of current through each of the three spark gap of the switch of FIGS. 3 and 4, but the power applied to the load 8 is supplied entirely by the high voltage source 57 of FIG. 5.

Figure 6:
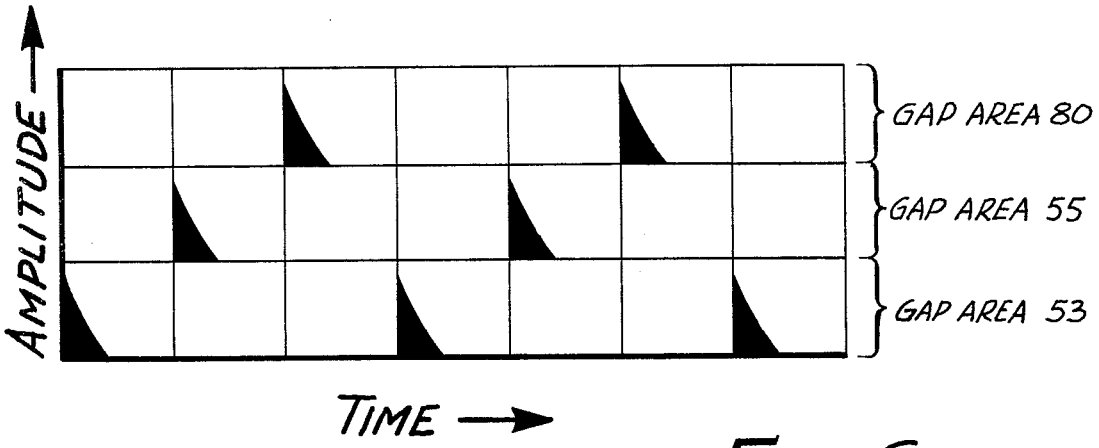
FIG. 6 is a timing diagram showing the firing and recovery times of the individual spark gaps of the embodiment of FIGS. 3-5; and, FIG. 7 is a timing diagram showing the switching action of the embodiment of FIGS. 3-6.
Figure 7:
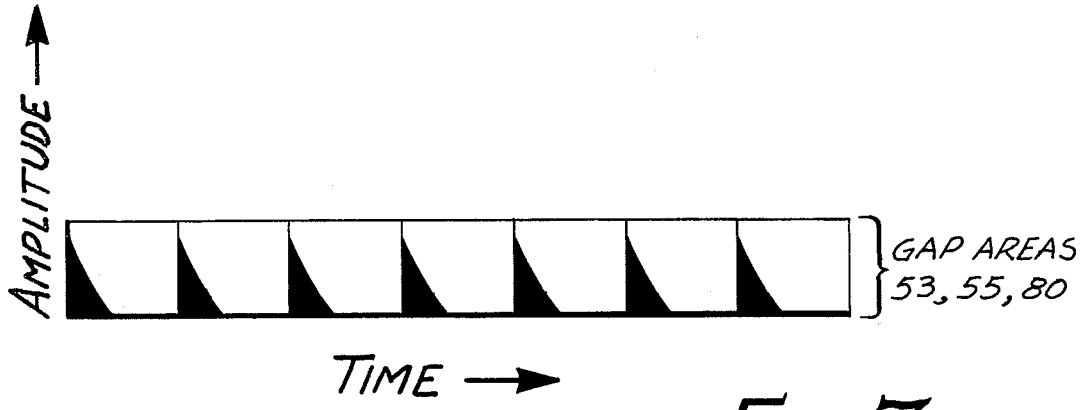

FIGS. 6 and 7 are timing diagrams which illustrate a particular manner of triggering the three spark gaps 53, 55, 80 to produce the combined output shown in FIG. 7. In this illustrative example, a uniform train of pulses (shown in FIG. 7) is desired, and as shown in FIG. 6 this is obtained in the present example by firing the spark gaps in a cyclical sequence. In FIGS. 6 and 7, the dark areas represent the discharge of current through the switch from the high voltage source 57 to the load, and the spaces between the pulses represent the time required to sweep the ionized particles from the gap to prepare it for the next firing period.

The firing sequence shown in FIGS. 6 and 7 is intended to be illustrative only, rather than limiting, and it can be appreciated that in other exemplary applications, it may be desirable to fire all three spark gaps simultaneously to provide fewer, but large current pulses, or alternatively, it may be desirable to fire the spark gaps in still other sequences to permit shaping of the output waveform in some desired manner.

Thus, there has been described in detail a spark gap switch improved to permit operation at hitherto unattainable pulse repetition rates (at the currents and voltages used). The improved spark gap of the preferred embodiment includes more than one independently-triggerable spark gap which are connected in parallel and which are swept in parallel by a fluid supplied under pressure. It is to be understood that additional embodiments of the present invention will be obvious to those skilled in the art. The embodiments described herein, together with those additional embodiments are considered to be within the scope of the invention.

What is claimed is:

1. A multiple-gap spark gap switch, comprising:

a first chamber having an inlet port for admitting a fluid;

a second chamber having an outlet port to permit egress of the fluid;

a first electrode partitioning said first chamber from said second chamber and having more than one separate passages extending through it, said first chamber communicating with said second chamber through the passages in said first electrode;

trigger electrodes each associated with one of the passages in said first electrode, each having a hollow cylindrical portion extending from within said first chamber into and concentric with the passage with which it is associated, that part of each hollow cylindrical portion lying within said first chamber having an opening to permit fluid to pass inside said hollow cylindrical portion from said first chamber to said passage; and, a set of second electrodes each associated with one of said trigger electrodes, each extending from within said second chamber into the trigger electrode with which it is associated and concentric with that trigger electrode, said set of second electrodes all being electrically interconnected;

whereby, fluid supplied to said first chamber through said inlet port flows through said passage on both the insides and outsides of the hollow cylindrical portions of said trigger electrode and into said second chamber, from which the fluid is discharged through said outlet port.

2. The multiple-gap spark gap switch of claim 1 further comprising in combination:

trigger bias means connected to each of said trigger electrodes for applying trigger pulses to said trigger electrodes in a desired predetermined sequence.

3. The multiple-gap spark gap switch of claim 2 wherein said trigger bias means further comprise:

a switching circuit;

trigger bias sources each connected to said switching circuit, and each connected to one of said trigger electrodes for generating trigger pulses in response to signals generated by said switching ciruit and for applying those trigger pulses to said trigger electrodes.

4. A spark gap switch comprising:

a first chamber having an electrically insulative wall and having an inlet port for admitting a flow of fluid;

a second chamber having an electrically insulative wall and having an outlet port for permitting egress of a fluid;

a first electrode partitioning said first chamber from said second chamber and having a passage through which said first chamber and said second chamber communicate;

a trigger electrode attached to the electrically insulative wall of said first chamber and having a hollow cylindrical portion extending from within said first chamber into and concentric with the passage in said first electrode, said hollow cylindrical portion having an aperture in that portion of its cylindrical wall lying within said first chamber to permit fluid to pass inside said hollow cylindrical portion from said first chamber to said passage; and, a second electrode attached to the electrically insulative wall of said second chamber and extending from within said second chamber into and concentric with the hollow cylindrical portion of said trigger electrode;

whereby, fluid supplied to said first chamber through said inlet port flows through said passage on both the inside and outside of the hollow cylindrical portion of said trigger electrode and into said second chamber from which the fluid is discharged through said outlet port.

5. The spark gap switch of claim 4 wherein said first chamber and said second chamber are cylindrical in shape and are located along a common central axis.

6. The spark gap switch of claim 5 wherein said electrically insulative walls of said first chamber and of said second chamber are end plates extending perpendicularly to said common central axis to close said first and said second chambers at their outermost ends.

7. The spark gap switch of claim 4 wherein said electrically insulative walls of said first chamber and of said second chamber are of a polycarbonate resin material.

8. The spark gap switch of claim 4 further comprising a baffle positioned in said first chamber adjacent said inlet port to cause turbulence in said fluid as it flows through said first chamber.

9. The spark gap switch of claim 8 wherein said baffle is cylindrical in shape, concentric with, but spaced radially from said trigger electrode.

* * * * *